US006250740B1

(12) United States Patent
Moghadam et al.

(10) Patent No.: US 6,250,740 B1
(45) Date of Patent: Jun. 26, 2001

(54) PAGEWIDTH IMAGE FORMING SYSTEM AND METHOD

(75) Inventors: Omid A. Moghadam, Pittsford; Christopher N. Delametter; Thomas E. Kocher, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/221,219

(22) Filed: Dec. 23, 1998

(51) Int. Cl.[7] ..... B41J 2/14
(52) U.S. Cl. ..... 347/48; 347/68; 347/56
(58) Field of Search ..... 347/54, 68, 20, 347/48, 56, 44

(56) References Cited

U.S. PATENT DOCUMENTS

| | | | | |
|---|---|---|---|---|
| 3,946,398 | | 3/1976 | Kyser et al. | 346/1 |
| 4,296,421 | * | 10/1981 | Hara et al. | 346/140 |
| 4,326,206 | * | 4/1982 | Raschke | 346/140 |
| 4,623,906 | * | 11/1986 | Chandrashekhar et al. | 346/140 |
| 5,023,625 | * | 6/1991 | Bares et al. | 346/1.1 |
| 5,581,286 | * | 12/1996 | Hayes et al. | 347/71 |
| 5,815,178 | * | 9/1998 | Silverbrook | 347/55 |
| 6,022,099 | * | 2/2000 | Chawalck et al. | 347/57 |

FOREIGN PATENT DOCUMENTS

| | | |
|---|---|---|
| 2007162 | 3/1979 | (GB) . |
| WO 90/14233 | 11/1990 | (WO) . |

* cited by examiner

*Primary Examiner*—John Barlow
*Assistant Examiner*—Blaise Mouttet
(74) *Attorney, Agent, or Firm*—Walter S. Stevens

(57) ABSTRACT

Pagewidth image forming system and method. The system features a plurality of mechanically isolated transducers capable of pressurizing an ink body associated with each of plural nozzle so that an ink meniscus extends from the ink body. The transducers are operated such that the ink bodies are uniformily intermittently pressurized. An ink droplet separator is also provided for lowering surface tension of the meniscus. In this regard, the droplet separator lowers the surface tension of the meniscus at a selected nozzle as the meniscus extends from the ink body, so that the meniscus forms a neck portion thereof. The extended meniscus severs from the ink body at the neck portion as the droplet separator lowers the surface tension to a predetermined value so as to form an ink droplet.

40 Claims, 7 Drawing Sheets

PAGEWIDTH IMAGE FORMING SYSTEM AND METHOD

BACKGROUND OF THE INVENTION

This invention generally relates to printing devices and methods, and more particularly relates to an image forming system and method for forming an image on a recording medium, the system including a thermo-mechanically activated drop-on-demand (DOD) pagewidth inkjet printhead which conserves power.

Ink jet printing is recognized as a prominent contender in digitally controlled, electronic printing because of its non-impact, low-noise characteristics, use of plain paper and avoidance of toner transfers and fixing. For these reasons, drop-on-demand printers have achieved commercial success for home and office use.

A drop-on-demand inkjet printer is disclosed in U.S. Pat. No. 3,946,398, which issued to Kyser et al. in 1970. This patent discloses a drop-on-demand ink jet printer which applies a high voltage to a piezoelectric crystal, causing the crystal to bend. As the crystal bends, pressure is applied on an ink reservoir for jetting ink drops on demand. Other types of piezoelectric drop-on-demand printers utilize piezoelectric crystals in push mode, shear mode, and squeeze mode. However, the patterning of piezoelectric crystal and the complex high voltage drive circuitry necessary to drive each printer nozzle are disadvantageous to cost effective manufacturability and performance. Also, the relatively large size of the piezo crystal prevents close nozzle spacing thereby making it difficult for this technology to be used to design high resolution page width printheads.

Great Britain Pat. No. 2,007,162, which issued to Endo et al. in 1979, discloses an electrothermal drop-on-demand ink jet printer that applies a power pulse to an electrothermal heater which is in thermal contact with water based ink in a nozzle. A small quantity of the ink rapidly evaporates, forming a bubble which causes drops of ink to be ejected from small apertures along an edge of a heater substrate. This technology is known as thermal ink jet printing.

More specifically, thermal ink jet printing typically requires heater energy of approximately 20 $\mu$J over a period of approximately 2 $\mu$sec to heat the ink to a temperature of 280–400° C. which causes rapid, homogeneous formation of a bubble. The rapid bubble formation provides momentum for drop ejection. Collapse of the bubble causes a pressure pulse on the thin film heater materials due to the implosion of the bubble. However, the high temperatures needed with this device necessitates use of special inks, complicates driver electronics, and precipitates deterioration of heater elements through kogation, which is the accumulation of ink combustion by-products that encrust the heater with debris. Such encrusted debris interferes with thermal efficiency of the heater. In addition, such encrusted debris may migrate to the ink meniscus to undesirably alter the viscous and chemical properties of the ink meniscus. Also, 10 Watt active power consumption of each heater prevents manufacture of low cost, high speed pagewidth printheads.

Another inkjet printing device is disclosed in commonly assigned U.S. patent application Ser. No. 08/621,754 filed on Mar. 22, 1996, in the name of Kia Silverbrook. The Silverbrook device provides a liquid printing system incorporating nozzles having a meniscus poised at positive pressure so that the meniscus extends from a nozzle tip. A heater surrounding the nozzle tip applies heat to the edge of the meniscus. This technique provides a drop-on-demand printing system wherein means (i.e., the heater) of selecting drops to be ejected produces a difference in meniscus position between selected drops and drops which are not selected, but which is insufficient to cause the ink drops to overcome the ink surface tension and separate from the body of ink. In this regard, an additional means is provided to cause separation of the selected drops from the body of ink. Such means of separation uses surface tension reduction and requires specialized inks. In addition, poising the meniscus at a positive pressure may cause nozzle leakage due to contamination present on any single nozzle. In this regard, application of an electric field or adjustment of receiver proximity is used to cause separation of the selected drops from the body of the ink. However, the electric field strength needed to separate the selected drop is above the value for breakdown in air so that close spacing between nozzle and receiver is needed; but, there is still the possibility of arcing. Causing separation of the drop using proximity mode, for which the paper receiver must be in close proximity to the orifice in order to separate the drop from the orifice, is unreliable due to the presence of relatively large dust particles typically found in an uncontrolled environment.

Yet another inkjet printing system is disclosed in commonly assigned U.S. patent application Ser. No. 09/017,827 (Attorney Docket No. 77,182) filed Feb. 3, 1998, in the name of Lebens et al. The Lebens device provides an image forming apparatus incorporating an ink jet printhead where a single transducer is used to periodically oscillate a body of ink in order to poise an ink drop and form a meniscus. The Lebens device further comprises an ink drop separator associated with the transducer for lowering the surface tension of the meniscus to separate the ink drop from the ink body. The device of the Lebens et al. patent can lead to edge effects in a large printheads, such as a pagewidth ink jet printhead, due to non-uniform poising of drops. In this case, use of a single oscillator can lead to menisci forming in the middle of the printhead and none forming at the ends of the printhead.

Consequently, there remains a widely recognized need for an ink jet printing technique, providing such advantages as reduced cost, pagewidth printing capability, increased speed, higher quality, greater reliability, reduced printhead edge effects, less power usage, and simplicity of construction and operation. The invention, which includes a thermo-mechanically activated DOD (Drop On Demand) printhead, obtains such advantages.

Therefore, there has been a long-felt need to provide a pagewidth image forming system and method for forming an image on a recording medium, which system is capable of conserving power.

SUMMARY OF THE INVENTION

An object of the present invention is to provide pagewidth image forming system and method for forming an image on a recording medium, the system including a thermo-mechanically activated DOD (Drop On Demand) printhead which conserves power.

With the above object in view, the invention resides in an image forming system, comprising a plurality of mechanically isolated transducers adapted to momentarily pressurize an ink body so that an ink meniscus extends from the ink body, the meniscus having a predetermined surface tension; and an ink droplet separator associated with said transducer for lowering the surface tension of the meniscus while the meniscus is extending from the ink body, whereby said droplet separator separates the meniscus from the ink body to form an ink droplet.

With the above object in view, the invention also resides in a drop on demand print head comprising a plurality of drop-emitter nozzles; a body of ink associated with said nozzles; a mechanically isolated pressurizing device adapted to subject said body of ink to a pulsating pressure above ambient, to intermittently form an extended meniscus; and drop separation apparatus selectively operable upon the meniscus of predetermined nozzles when the meniscus is extended to cause ink from the selected nozzles to separate as drops from the body of ink, while allowing ink to be retained in non-selected nozzles.

According to an embodiment of the invention, a plurality of mechanically isolated pressure transducers periodically oscillate the meniscus which extends from the ink body and an ink droplet separator associated with a heater alters physical properties of the ink resulting in a reduction in the surface tension of the ink in a neck region of the extended meniscus. The timely application of a heat pulse increases the instability of the meniscus in the neck region, thereby causing separation of the meniscus from the ink body to form an ink droplet.

The image forming system of the present invention comprises a printhead including a plurality of nozzles, each nozzle having a nozzle orifice and defining a chamber having an ink body therein in communication with the orifice. In fluid communication with all the ink bodies is a number of mechanically isolated oscillatable piezoelectric transducers for alternately and uniformly pressurizing and depressurizing the ink bodies. When the ink bodies are pressurized, a plurality of ink menisci extend from respective ones of the orifices and when the ink bodies are depressurized, the menisci retract into their respective orifices. As each meniscus is pushed out by a positive pressure wave, a slight necking is seen before the drop is retracted back in the nozzle by a negative pressure wave. Increasing the amplitude of the pressure wave by a predetermined amount (e.g., 20%) above preferred operating conditions causes complete necking of the meniscus and ejection of the drop. A timely application of electrothermal pulses to an annular heater located around the rim of each nozzle increases the necking instability for selected nozzles to thereby eject and propel the drop to a receiver. The electrothermal pulse applied to the annular heater causes a heating of the drop in the neck region for altering material properties of the ink, including a reduction in the surface tension of the ink in the neck region which increases the necking instability. That is, at a point in time when the oscillating menisci are extended, predetermined ones of the heaters are selectively activated to lower surface tension of the menisci. In this regard, the selected heaters deliver a relatively small pulse of heat energy to predetermined ones of the extended menisci so that the extended menisci further extend from their orifices during separation.

When the meniscus is at or near peak extension from the nozzle during the pressurization portion of the droplet separation cycle, there is net flow of ink outwardly from the nozzle. In addition, because the heater is in heat transfer communication with the meniscus and because, during pressurization, pressure generated by the transducer forces the heated meniscus towards the surface of the nozzle, most of the thermal energy is utilized to keep the nozzle's exterior surface at an elevated temperature. In this manner, a relatively small amount of thermal energy is lost to the ink body and nozzle substrate. Such relatively minimal thermal energy loss obtains increased energy efficiency for the printhead. Moreover, the ink in the nozzle orifice area remains relatively cool and the nozzle orifice remains clean of residue, thus preventing undesired misfiring of the nozzles.

A feature of the present invention is the provision of a plurality of mechanically isolated oscillating piezoelectric transducers in fluid communication with a plurality of ink menisci reposed at respective ones of a plurality of nozzles for alternately pressurizing and depressurizing the menisci in a uniform manner, so that the menisci, along the length of the printhead, extend from the nozzle as the menisci are pressurized and retract into the nozzle as the menisci are depressurized, thus minimizing printhead end effects associated with non uniform pressurization and depressurization using a single transducer.

Another feature of the present invention is the provision of a plurality of heaters in heat transfer communication with respective ones of the ink menisci, the heaters being selectively actuated only as the menisci extend a predetermined distance from the nozzles for separating selected ones of the menisci from their respective nozzles.

An advantage of the present invention is that use thereof increases reliability of the printhead.

Another advantage of the present invention is that use thereof conserves power.

Yet another advantage of the present invention is that the heaters belonging thereto are longer-lived.

A further advantage of the present invention is that use thereof allows more nozzles per unit volume of the printhead to increase image resolution.

An additional advantage of the present invention is that use thereof allows faster printing.

Still another advantage of the present invention is that a vapor bubble is not formed at the heater, which vapor bubble formation might otherwise lead to kogation.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figures 1, 1A:
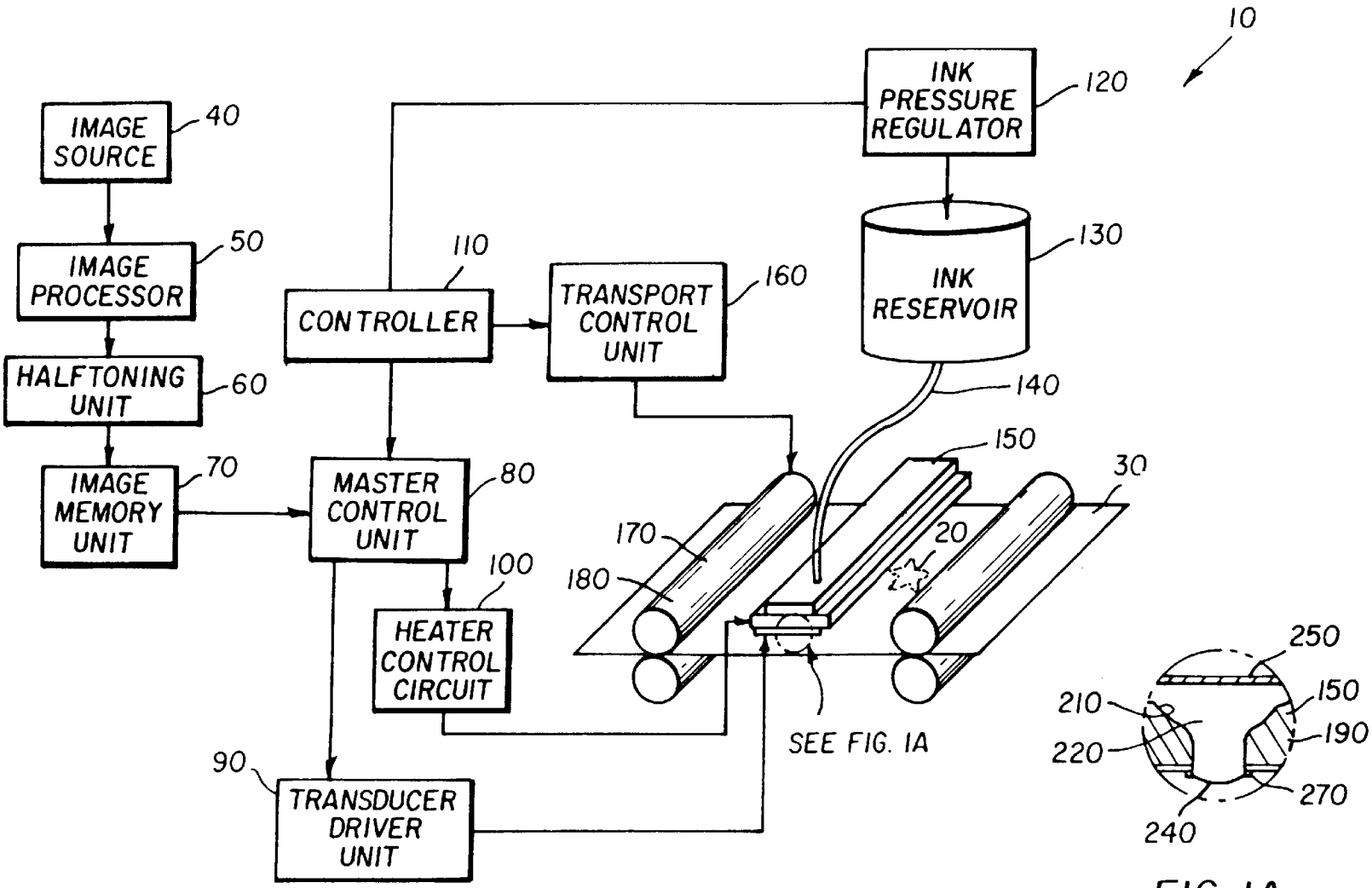
FIG. 1 shows a functional block diagram of an image forming system according to the present invention.
FIG. 1*a* is an enlarged view in vertical section of a nozzle belonging to the invention.

Therefore, referring to FIG. 1, there is shown a functional block diagram of an image forming system, generally referred to as 10, for forming an image 20 on a recording medium 30. Recording medium 30 may be, for example, sheets of paper or transparency. As described in detail hereinbelow, system 10 includes a thermo-mechanically activated DOD (Drop-On-Demand) pagewidth inkjet printhead which conserves power and lowers printhead edge effects generally associated with pagewidth ink jet printers.

Still referring to FIG. 1, system 10 comprises an input image source 40, which may be raster image data from a scanner (not shown) or computer (also not shown), or outline image data in the form of a PDL (Page Description Language) or other form of digital image representation. Image source 40 is connected to an image processor 50, which converts the image data to a pixel-mapped page image comprising continuous tone data. Image processor 50 is in turn connected to a digital halftoning unit 60 which halftones the continuous tone data produced by image processor 50. This halftoned bitmap image data is temporarily stored in an image memory unit 70 connected to halftoning unit 60. Depending on the configuration selected for system 10, image memory unit 70 may be a full page memory or a so-called band memory. For reasons described more fully hereinbelow, output data from image memory unit 70 is read by a master control circuit 80, which controls both a transducer driver circuit 90 and a heater control circuit 100.

Referring again to FIG. 1, system 10 further comprises a microcontroller 110 connected to master control circuit 80 for controlling master control circuit 80. As previously mentioned, control circuit 80 in turn controls transducer driver circuit 90 and heater control circuit 100. Controller 110 is also connected to an ink pressure regulator 120 for controlling regulator 120. A purpose of regulator 120 is to regulate pressure in an ink reservoir 130 connected to regulator 120, which reservoir 130 contains a reservoir of ink therein for marking recording medium 30. Ink reservoir 130 is connected, such as by means of a conduit 140, to a printhead 150, which may be a DOD inkjet printhead. In addition, connected to controller 110 is a transport control unit 160 for electronically controlling a recording medium transport mechanism 170. Transport mechanism 170 may include a plurality of motorized rollers 180 aligned with printhead 150 and adapted to intimately engage recording medium 30. In this regard, rollers 180 rotatably engage recording medium 30 for transporting recording medium 30 past printhead 150. It may be understood that in pagewidth printing, printhead 150 remains stationary and recording medium 30 is moved past stationary printhead 150.

Figure 2:
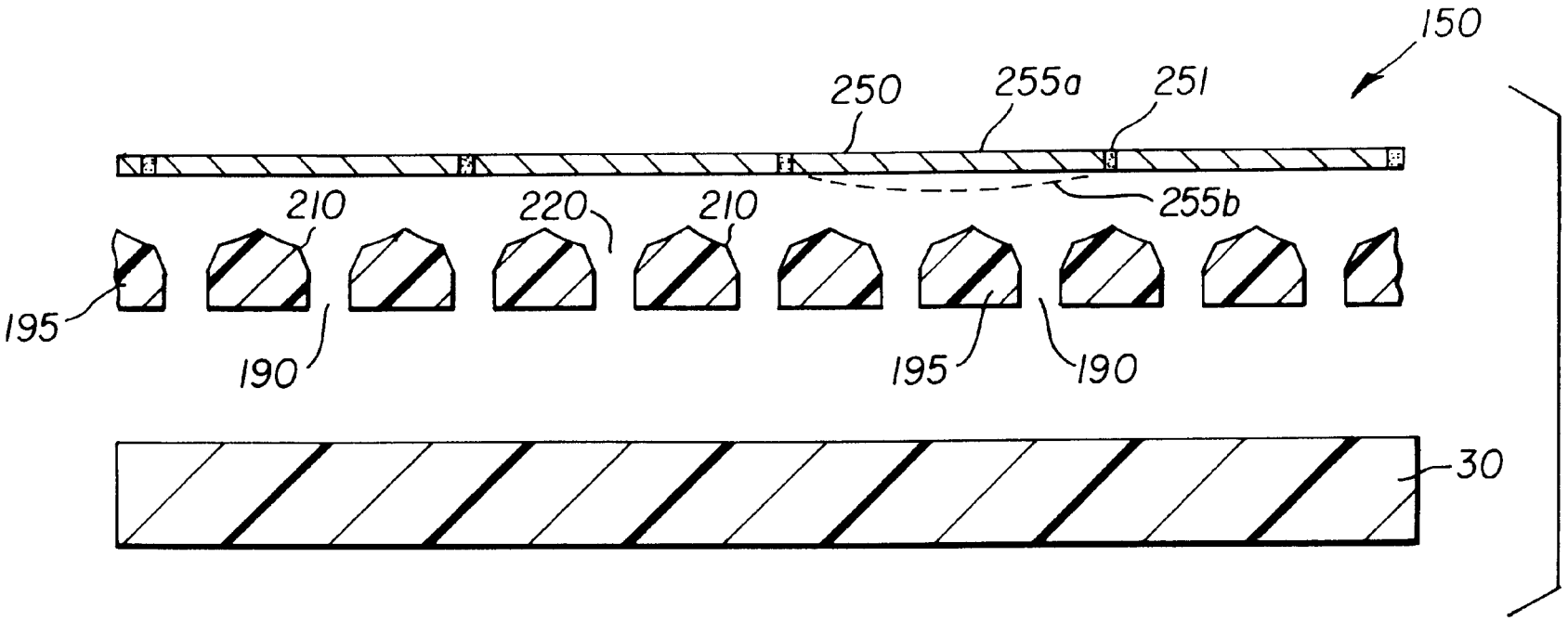
FIG. 2 is a view in vertical section of a printhead belonging to the image forming system of the present invention, the printhead including a plurality of the nozzles each having an ink body therein and ink menisci connected to the ink body, each ink body shown pressurized by a plurality of mechanically isolated transducers.
Figure 5:
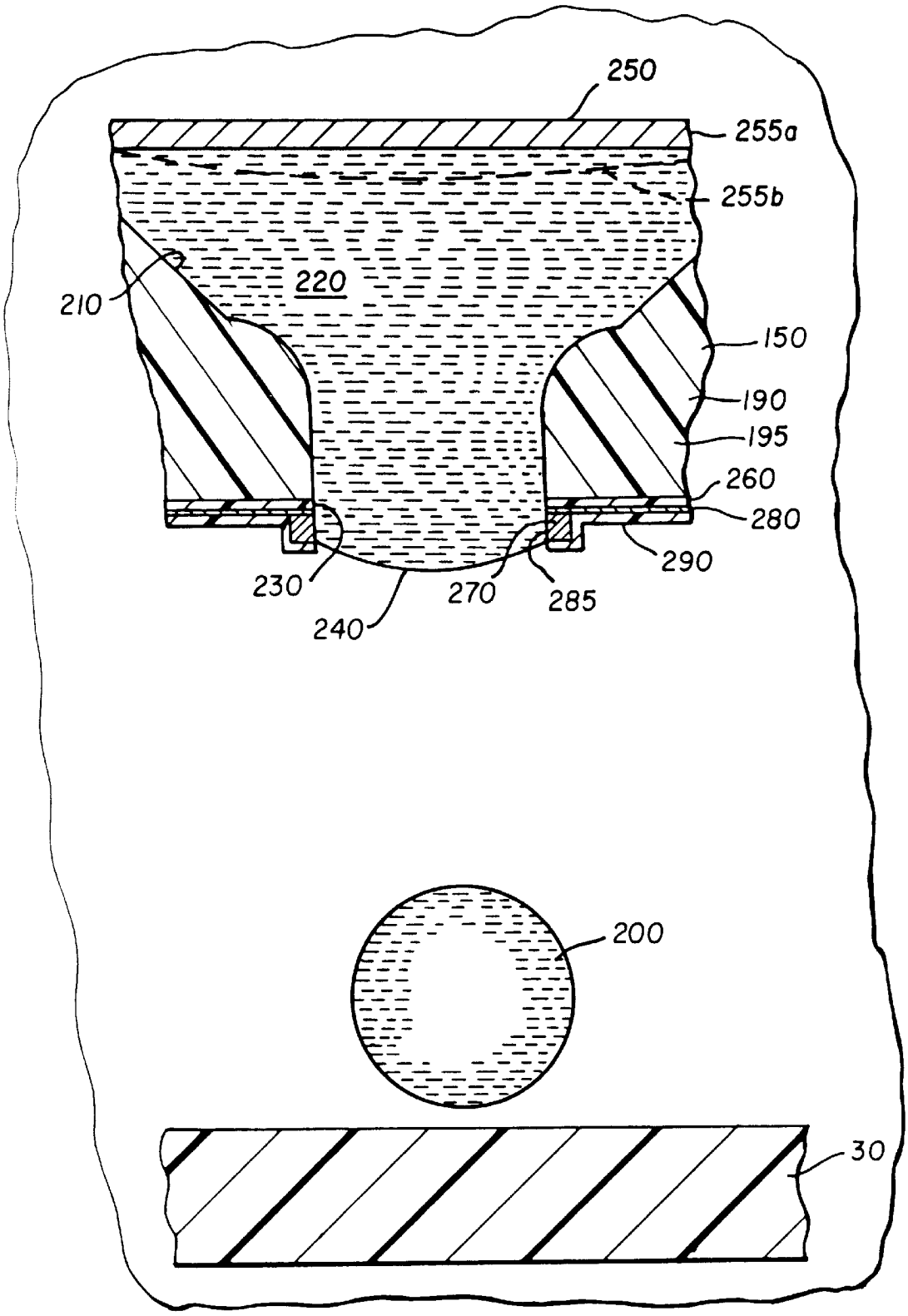
FIG. 5 is a view in vertical section of the nozzle, the meniscus having been severed from the nozzle so as to define a generally spherically-shaped ink droplet traveling toward a recording medium.

Turning now to FIGS. 1*a* and 2, printhead 150 comprises a plurality of nozzles 190, each nozzle 190 capable of ejecting an ink droplet 200 (see FIG. 5) therefrom to be intercepted by a receiver such as recording medium 30. As shown in FIG. 2, each nozzle 190 is etched in an orifice plate or substrate 195, which may be silicon, and defines a channel-shaped chamber 210 in nozzle 190. Chamber 210 is in communication with reservoir 130, such as by means of previously mentioned conduit 140, for receiving ink from reservoir 130. In this manner, ink flows through conduit 140 and into chamber 210 such that an ink body 220 is formed in chamber 210. Also, printhead 150 comprises a plurality of transducers 250 which are mechanically isolated from one another by mechanical isolators 251. The purpose of mechanical isolators 251 is to isolate the movement of transducers 250 from one another, and hence provide uniform pressure in ink body 220 in chamber 210 along length of printhead 150 and to reduce printhead edge effects associated with the use of a single transducer in pagewidth printheads. Mechanical isolators 251 may be made of aluminum nitrite material when transducers 250 are made of piezoelectric material.

Figure 2A:
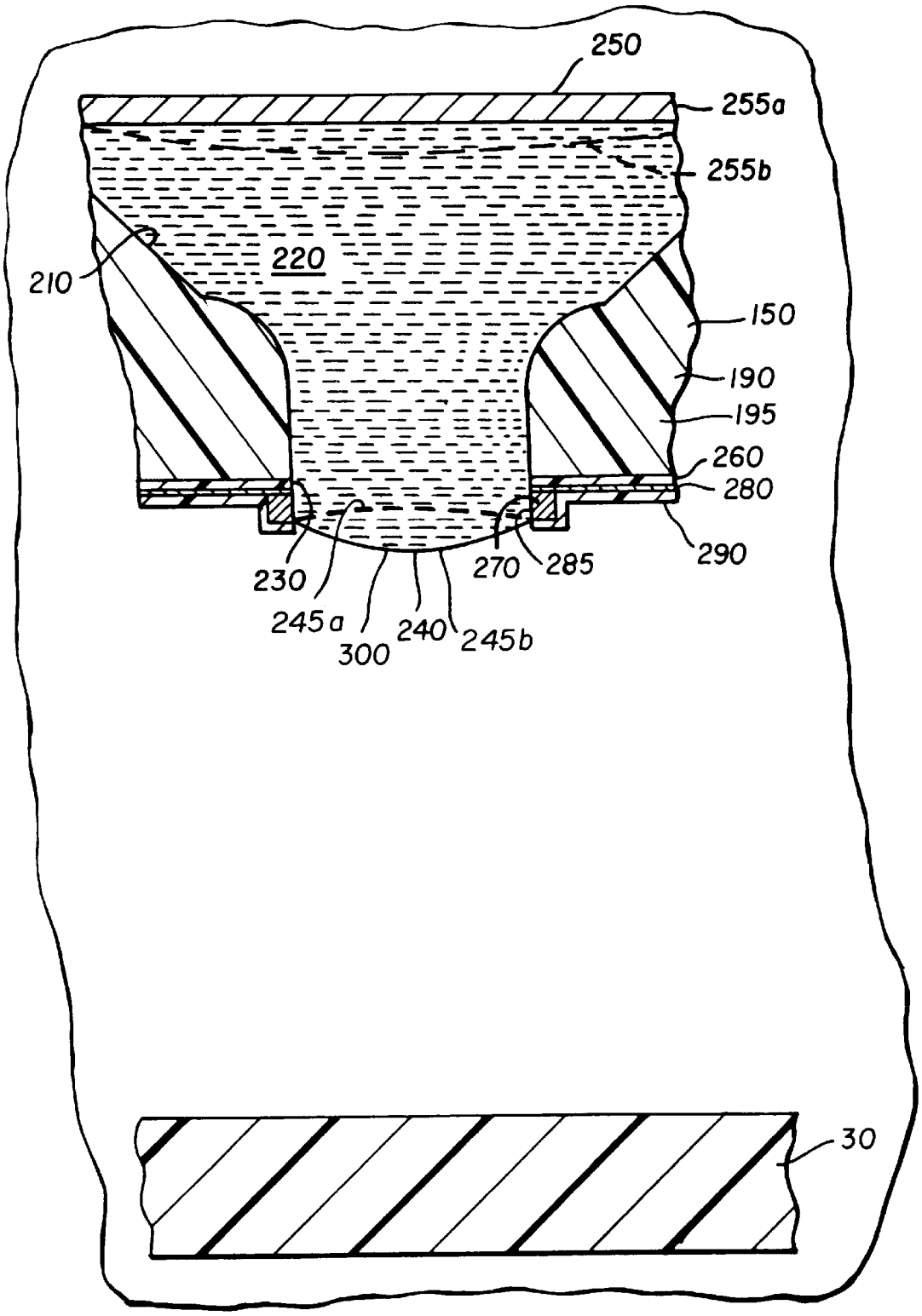
FIG. 2*a* is a view in vertical section of one of the printhead nozzles belonging to the image forming system of the present invention, the nozzle having the ink body therein and an ink meniscus connected to the ink body.

Turning now to FIG. 2*a*, printhead 150 comprises previously mentioned nozzles 190 (only one of which is shown), each nozzle 190 capable of ejecting ink droplet 200 (see FIG. 5) therefrom to be intercepted by recording medium 30. Ink flows through conduit 140 and into chamber 210 such that an ink body 220 is formed in chamber 210. In addition, nozzle 190 defines a nozzle orifice 230 communicating with chamber 210. An ink meniscus 240 is disposed at orifice 230 when ink body 220 is disposed in chamber 210. By way of example only and not by way of limitation, orifice 230 may have a radius of approximately 8 $\mu$m.

Referring again to FIG. 2*a*, in the absence of an applied heat pulse, meniscus 240 is capable of oscillating between a first position 245*a* (shown, for example, as a dashed curved line) and an extended meniscus second position 245*b*. It may be appreciated that, in order for meniscus 240 to oscillate, ink body 220 must itself oscillate because meniscus 240 is integrally formed with ink body 220. To oscillate each ink body 220, a plurality of oscillatable piezoelectric transducers 250 span respective ones of chambers 210 and are in fluid communication with ink bodies 220 in those chambers 210. In the preferred embodiment of the invention, piezoelectric transducers 250 are capable of accepting, for example, a 25 volt, 50 $\mu$s square wave electrical pulse, although other pulse shapes, such as triangular or sinusoidal shapes and other voltage amplitudes may be used, if desired. Transducers 250 are capable of deforming so as to evince oscillatory motion from their unstressed position 255*a* to a concave inwardly-directed position 255*b*. More specifically, when transducers 250 move to concave inward position 255*b*, volume of chamber 210 decreases and menisci 240 extends outwardly from orifice 230 as shown by second position 245*b*. Similarly, when transducers 250 return to their unstressed position 255*a*, volume of chambers 210 returns to their initial state and ink is retracted into the nozzles with menisci 240 returning to concave first position 245*a*. As described hereinabove, transducer 250 is activated using a driving current so that transducer 250 pressurizes and depressurizes chamber 210. Such piezoelectric transducer 250 may be selected so that they deflect in shear mode or transducers 250 may be selected so that they deflect in non-shear mode, if desired. By way of example only, and not by way of limitation, transducer 250 preferably pressurizes chamber 210 to a pressure of approximately 3–5 lbs./in$^2$ gauge and preferably depressurizes chambers 210 to a pressure of approximately negative 2–5 lbs./in$^2$ gauge. Thus, meniscus 240 does not experience a static (i.e., constant) back pressure. Rather, chamber 210 and therefore ink body 220 experience a dynamic pressure acting therewithin merely to oscillate menisci 240 in orifice 230. It is important that menisci 240 does not experience static back pressure. This is important because such static back pressure otherwise increases risk that ink will leak from nozzle 190. Moreover, although transducers 250 are described as a piezoelectric transducers, transducers 250 may be any one of other types of materials or structures capable of suitably oscillating. For example, piezoelectric transducers 250 may be replaced by a number of electromagnetically-operated structures or structures comprising of two plates that are bonded together so that they amplify their mechanical actions. An example of such a structure is a "Bimorph"® transducer manufactured by Morgan Matroc, Incorporated, Electro Ceramic Division, located in Bedford, Ohio, U.S.A. "Bimorph"® is a registered trademark of Morgan Matroc, Incorporated.

Figure 3:
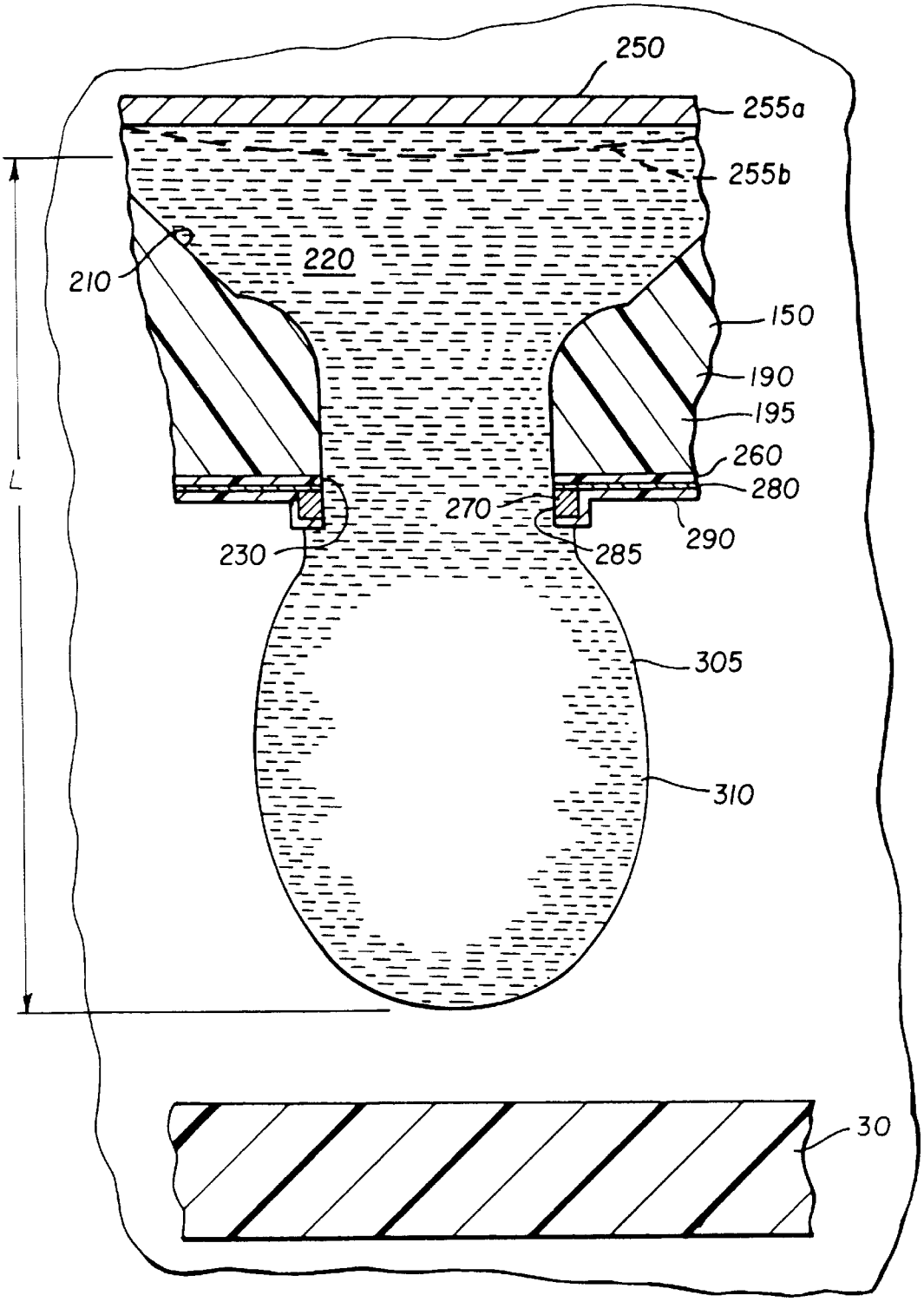
FIG. 3 is a view in vertical section of the printhead nozzle showing an ink meniscus outwardly extending from the nozzle, this view also showing a heater surrounding the nozzle and in heat transfer communication with the extended meniscus to lower surface tension of the extended ink meniscus in order to separate the extended ink meniscus from the nozzle.
Figure 4:
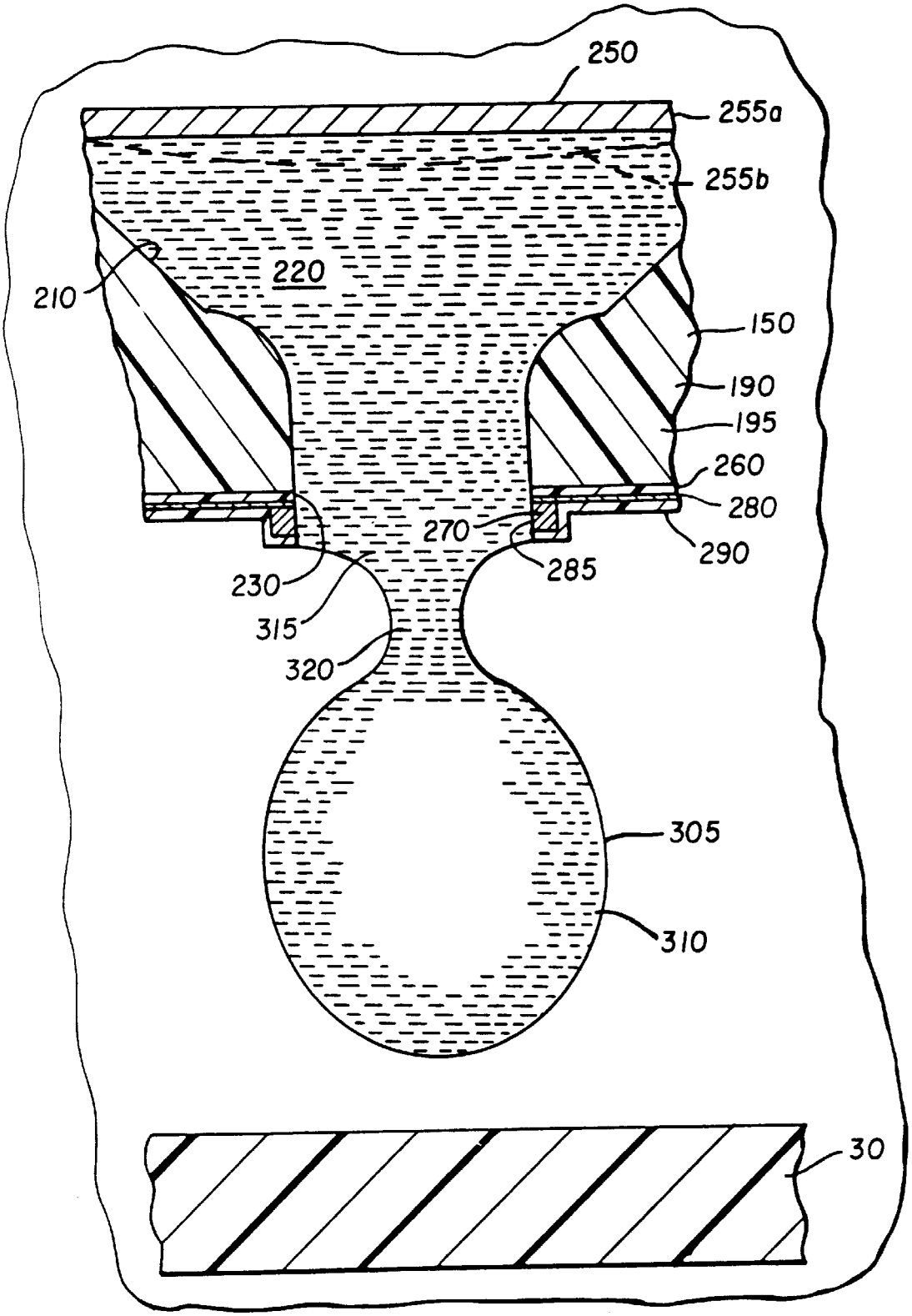
FIG. 4 is a view in vertical section of the nozzle having the meniscus further outwardly extending from the nozzle as the surface tension lowers, the meniscus having a neck portion.

Still referring to FIGS. 2*a*, 3 and 4, it is seen that as transducers 250 are stressed to position 255*b*, volume of chamber 210 decreases so that menisci 240 extend from the orifices 230 as shown by second position 245*b*. If the amplitude of transducer 250 motion is further increased by, for example, approximately 20%, necking of the menisci occurs with ink drops separating from nozzles 190 during movement of transducers 250 to their unstressed position 255*a*. With proper adjustment of the amplitude of transducers 250, repeated retraction of the menisci 240 are possible without the separation of drops in the absence of a heat pulse. To ensure necking instability of menisci 240 when a heat pulse is applied, the ink is formulated to have a surface tension which decreases with increasing temperature. Consequently, a heat pulse is applied to meniscus 240 to separate an ink droplet from nozzle 190.

Figure 4A:
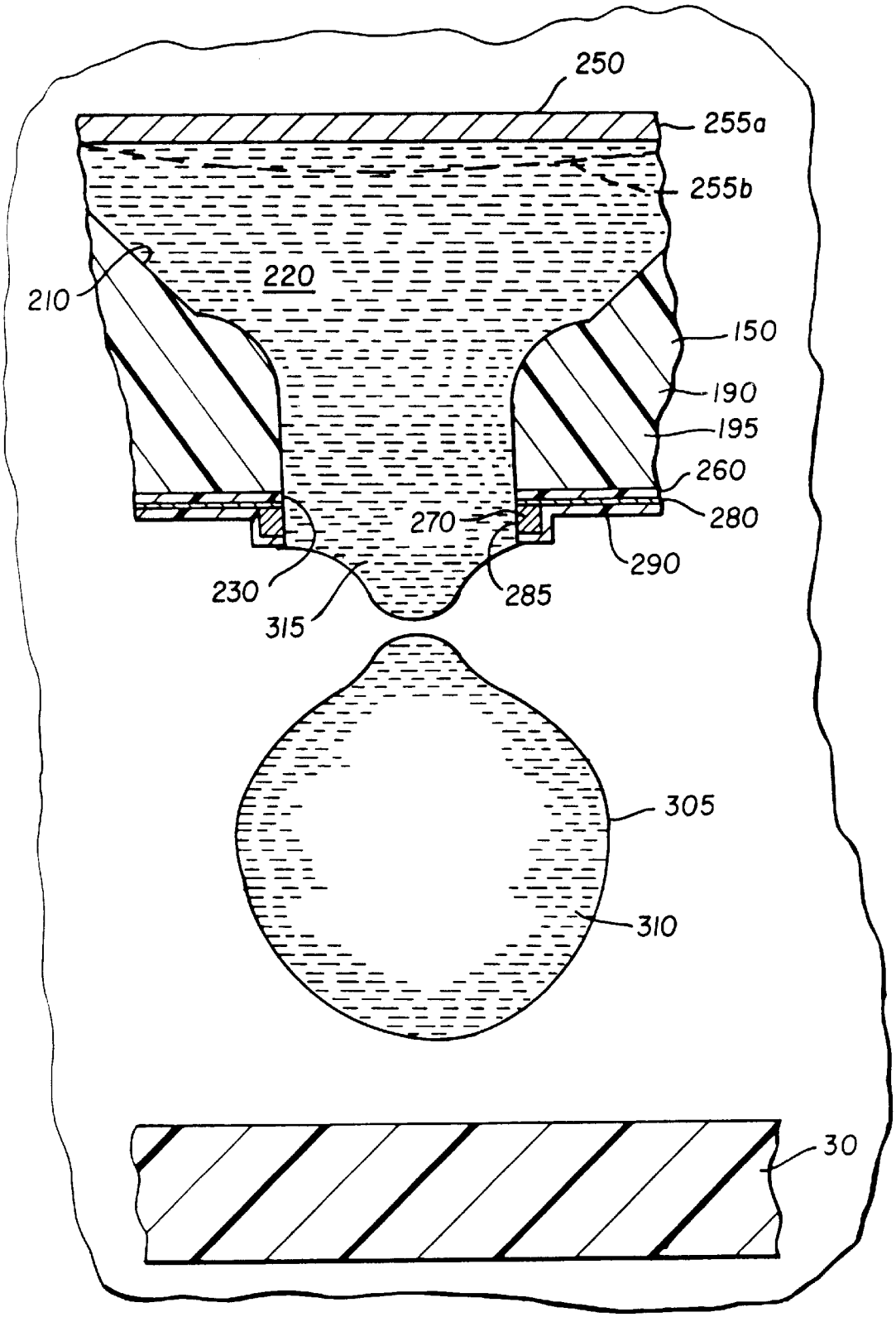
FIG. 4*a* is a view in vertical section of the nozzle, the meniscus shown in the act of severing from the nozzle and obtaining a generally oblong elliptical shape.

Therefore, as best seen in FIGS. 3, 4 and 4*a*, an ink droplet separator, such as an annular heater 270, is provided for separating meniscus from orifice 230, so that droplet 200 leaves orifice 230 and travels to recording medium 30. More specifically, an intermediate insulation layer 260, which may be formed from silicon dioxide, covers substrate 195. The purpose of layer 260 is to provide thermal and electrical insulation, as described more fully momentarily. Heater 270 rests on substrate 195 and preferably is in fluid communication with menisci 240 for separating menisci 240 from nozzle 190 by lowering surface tension of menisci 240. Of course, heater 270 is also in heat transfer communication with menisci 240 for heating menisci 240. More specifically, annular heater 270 surrounds orifice 230 and is connected to a suitable electrode layer 280 which supplies electrical energy to heater 270, so that the temperature of heater 270 increases. Moreover, annular heater 270 forms a generally circular lip or orifice rim 285 encircling orifice 230. Although heater 270 is preferably annular, heater 270 may comprise one or more arcuate-shaped segments disposed adjacent to orifice 230, if desired. Heater 270 may advantageously comprise arcuate-shaped segments in order to provide directional control of the separated ink drop. By way of example only and not by way of limitation, heater 270 may be doped polysilicon. Also, by way of example only and not by way of limitation, heater 270 may be actuated for a time period of approximately 20 $\mu$s. Thus, intermediate layer 260 provides thermal and electrical insulation between heater 270 and electrode layer 280 on the one hand and substrate 195 on the other hand. In addition, an exterior protective layer 290 is provided for protecting substrate 195, heater 270, intermediate layer 260 and electrode layer 280 from damage by resisting corrosion and fouling. By way of example only and not by way of limitation, protective layer 290 may be polytetrafluroethylene chosen for its anti-corrosive and anti-fouling properties. In the above configuration, printhead 150 is relatively simple and inexpensive to fabricate and also easily integrated into a CMOS process.

Returning briefly to FIG. 1, transducers 250 and heaters 270 are controlled by the previously mentioned transducer driver circuit 90 and heater control circuit 100, respectively. Transducer driver circuit 90 and heater control circuit 100 are in turn controlled by master control circuit 80. Master control circuit 80 controls transducer driver circuit 90 so that transducer 250 oscillates at a predetermined frequency. Moreover, master control circuit 80 reads data from image memory unit 70 and applies time-varying electrical pulses to predetermined ones of heaters 270 to selectively release droplets 200 in order to form ink marks at pre-selected locations on recording medium 30. It is in this manner that printhead 150 forms image 20 according to data that was temporarily stored in image memory unit 70.

Referring to FIGS. 2*a*, 3, 4 and 5, meniscus 240 outwardly extends from orifice 230 to a maximum distance "L" before reversal of transducer 250 motion causes meniscus 240 to retract in the absence of a heat pulse. FIGS. 3 and 4 specifically depict the case in which a heat pulse is applied by means of heater 270 while the meniscus 240 is outwardly expanding. Timing of the heat pulse is controlled by heater control circuit 100. The application of heat by heater 270 causes a temperature rise of the ink in a neck region 320. In this regard, temperature of neck region 320 is preferably greater than 100C. but less than a temperature which would cause the ink to form a vapor bubble. Reduction in surface tension causes increased necking instability of the expanding meniscus 240 as depicted in FIG. 4. This increased necking instability, along with the reversal of motion of transducers 250 causes neck region 320 to break (i.e., sever). When this occurs, a new meniscus 240 forms after droplet separation and retracts into orifice 230. The momentum of the droplet 200 that is achieved is sufficient, with droplet velocities of 7 m/sec, to carry it to recording medium 30 for printing. The remaining newly formed ink meniscus 240 is retracted back into nozzle 190 as piezo transducers 250 return to their unstressed position 255*a*. This newly formed meniscus 240 can then be extended during the next cycle of transducer oscillation. By way of example only and not by way of limitation, the total droplet ejection cycle may be approximately 144$\mu$s. In this manner, transducer motion and timing of heat pulses are electrically controlled by transducer driver circuit 90 and heater control circuit 100, respectively. Thus, it may be appreciated from the description hereinabove, that system 10 obtains a thermo-mechanically activated printhead 150 because heaters 270 supply thermal energy to meniscus 240 and transducer 250 supplies mechanical energy to meniscus 240 in order to produce droplet 200.

It may be appreciated from the teachings herein that an advantage of the present invention is that printhead edge effects are significantly reduced in pagewidth inkjet printing. This is achieved by providing uniform pressure in every chamber by using a plurality of transducers assigned to each chamber to provide a uniform drop selection mechanism which can be applied simultaneously to all nozzles.

It is understood from the teachings herein that another advantage of the present invention is that there is no significant static back pressure acting on chamber 210 and ink body 220. Such static back pressure might otherwise cause inadvertent leakage of ink from orifice 230. Therefore, image forming system 10 has increased reliability by avoiding inadvertent leakage of ink.

Still another advantage of the present invention is that use thereof requires less heat energy than prior art thermal bubblejet printheads. This is so because the heater 270 of the invention is used to lower the surface tension of a small region (i.e., neck region 320) of the meniscus 240 rather than requiring latent heat of evaporation to form a vapor bubble. This is important for high density packing of nozzles without overheating of the substrate. Therefore, image forming system 10 advantageously uses less energy per nozzle than prior art devices.

Yet another advantage of the present invention is that heaters 270 are longer-lived because the low power level that is used prevents cavitation damage due to collapse of vapor bubbles and kogation damage due to burned ink depositing on heater surfaces.

A further advantage of the present invention is that a relatively small number of transducers 250 are used rather than a much larger number of transducers. Therefore complexity is reduced compared to prior art devices. This is possible because transducers 250 do not themselves eject droplet 200; rather, transducers 250 merely oscillate menisci 240 so that menisci 240 are pressurized and move to position 245*a* in preparation for each ejection. It is the lowering of surface tension by means of heater 270 that finally allows droplet 200 to be ejected. Use of a plurality of transducers 250 to merely oscillate menisci 240, rather than to eject droplet 200, eliminates so-called "cross-talk" between chambers 210. This is so because it is the heat applied by the heaters at each nozzle that actually ejects the droplets. That is, the heat applied to the meniscus at any one nozzle selected for actuation does not affect the meniscus at an adjacent nozzle. In other words, there is no significant heat transfer between adjacent nozzles. Elimination of cross-talk between chambers 210 allows more chambers 210 per unit volume of printhead 150. More chambers 210 per unit volume of printhead 150 results in denser packing of chambers 210 in printhead 150, which in turn allows for higher image resolution.

An additional advantage of the present invention is that the velocity of the drop of approximately 7 m/sec is large enough that no additional means of moving drops to receiver is necessary. This is in contrast to prior art low energy use printing systems.

The invention has been described in detail with particular reference to certain preferred embodiments thereof, but it should be understood that variations and modifications can be effected within the spirit and scope of the invention. For example, ink body 220 need not be in a liquid state at room temperature. That is, solid "hot melt" inks can be used, if desired, by heating printhead 150 and reservoir 130 above the melting point of such a solid "hot melt" ink.

Therefore, what is provided is an image forming system and method for forming an image on a recording medium, the system including a thermo-mechanically activated DOD (Drop On Demand) printhead which conserves power.

PARTS LIST

L . . . maximum meniscus extension distance in absence of heating pulse

10 . . . image forming system
20 . . . image
30 . . . recording medium
40 . . . image source
50 . . . image processor
60 . . . halftoning unit
70 . . . image memory unit
80 . . . master control circuit
90 . . . transducer driver circuit
100 . . . heater control circuit
110 . . . controller
120 . . . ink pressure regulator
130 . . . ink reservoir
140 . . . conduit
150 . . . printhead
160 . . . transport control unit
170 . . . transport mechanism
180 . . . rollers
190 . . . nozzle
195 . . . substrate
200 . . . ink droplet
210 . . . chamber
220 . . . ink body
230 . . . nozzle orifice
240 . . . ink meniscus
245*a* . . . first position of meniscus
245*b* . . . second position of meniscus
250 . . . transducer
251 . . . mechanical isolator
255*a* . . . first position of transducer
255*b* . . . second position of transducer
260 . . . intermediate layer
270 . . . heater
280 . . . electrode layer
285 . . . orifice rim
290 . . . protective layer
300 . . . surface area of ink meniscus
305 . . . expanded surface area of ink meniscus
310 . . . extended ink meniscus body
315 . . . posterior portion of extended ink meniscus body
320 . . . necked portion

What is claimed is:

1. An image forming system, comprising:

(a) a plurality of ink ejecting nozzle orifices;

(b) a plurality of mechanically isolated transducers adapted to momentarily pressurize an ink body so that an ink meniscus extends from each of the nozzle orifices, the meniscus having a predetermined surface tension and the number of transducers being greater than one and less than the number of orifices; and (c) an ink droplet separator for lowering the surface tension of a meniscus selected for ejection as a droplet while the meniscus is extending from the nozzle orifice whereby said droplet separator separates the meniscus from the ink body to form an ink droplet that is ejected at a speed sufficient as to require no additional means of moving the droplet to a receiver.

2. The system of claim 1, wherein said droplet separator comprises a heater for heating a neck region of the meniscus.

3. The system of claim 2, further comprising a first control circuit connected to said heater for controlling said heater, so that said heater controllably heats the meniscus at a predetermined time.

4. The system of claim 3, wherein said heater controllably heats the meniscus to a temperature less than that which would cause a vapor bubble to be created.

5. The system of claim 1, wherein said droplet separator comprises a heater in contact with the meniscus.

6. The system of claim 1, further comprising a second control circuit connected to said transducer for controlling said transducer, so that said transducer controllably pressurizes the ink body.

7. An inkjet image forming system, comprising;

(a) a plurality of nozzles each nozzle defining a chamber therein for holding an ink body, said nozzle having a nozzle orifice in communication with the chamber, the orifice accommodating an ink meniscus of predetermined surface tension connected to the ink body and an ink body of each nozzle being in communication with ink in a common ink channel;

(b) a plurality of mechanically isolated oscillatable transducers in fluid communication with ink in the common ink channel and with the ink body for alternately pressurizing and depressurizing the ink body, so that each ink body oscillates as the ink body is alternately pressurized and depressurized and so that the meniscus extends beyond the orifice and retracts as the ink body is respectively pressurized and depressurized, whereby each ink body oscillates in the respective chamber as said transducers oscillate, the ink body is alternately pressurized and depressurized as the ink body oscillates, and the meniscus extends from the orifice as the ink body is pressurized, and the number of transducers being greater than one and less than the number of nozzle orifices; and (c) a droplet separator adapted to lower the surface tension of the meniscus while the meniscus is extending from a selected orifice, whereby said separator lowers the surface tension of the meniscus as the meniscus extends from an orifice selected for droplet ejection, and the meniscus separates from the selected orifice at a speed sufficient as to require no additional means of moving the droplet to a receiver.

8. The system of claim 7, wherein said droplet separator comprises a heater for heating a neck region of the meniscus.

9. The system of claim 8, further comprising a heater control circuit connected to said heater for controlling said heater, so that said heater controllably heats the meniscus.

10. The system of claim 8, wherein said heater surrounds the nozzle.

11. The system of claim 8, wherein said heater heats the meniscus to a temperature less than that that would cause a vapor bubble to be created.

12. The system of claim 7, further comprising a driver control circuit connected to said transducers for controlling said transducers, so that said transducers controllably oscillate to alternately pressurize and depressurize the ink body.

13. The system of claim 7, wherein said transducers are piezoelectric transducers.

14. The system of claim 7, wherein said transducers are electromagnetically operated transducers.

15. A drop-on-demand inkjet image forming system for forming an image on a recording medium, comprising;

(a) a printhead;

(b) a plurality of nozzles integrally connected to said printhead, each nozzle defining a chamber therein for holding an ink body, each of said nozzles having a nozzle orifice in communication with respective ones of the chambers, each orifice accommodating an ink meniscus of predetermined surface tension connected to the ink body;

(c) a plurality of mechanically isolated oscillatable piezoelectric transducers in fluid communication with all the ink bodies for alternately pressurizing and depressurizing the ink bodies, so that the ink bodies oscillate as the ink bodies are alternately pressurized and depressurized and so that the menisci oscillate as the ink bodies oscillate, and the number of transducers being greater than one and less than the number of nozzle orifices;

(d) a plurality of heaters and in heat transfer communication with respective ones of the ink menisci for lowering the surface tension of selected ones of the menisci as the ink bodies are pressurized; and (e) a heater control circuit connected to each of said heaters for actuating selected ones of said heaters, so that said selected ones of said heaters controllably heats the selected ones of the menisci, whereby each of the ink bodies oscillates as said transducers oscillate, whereby each of the ink bodies is alternately pressurized and depressurized as each of the ink bodies oscillates, whereby each of the menisci oscillates as each of the ink bodies oscillates, whereby the surface tension of the selected ones of the menisci is lowered as the selected ones of the menisci are heated, whereby the selected ones of the menisci defines a neck portion thereof as the surface tension lowers, whereby each of the neck portions sever as the surface tension lowers, and whereby the selected ones of the menisci separate from the orifices corresponding thereto as the neck portions thereof sever in order to form a plurality of ink droplets that are ejected at a speed sufficient as to require no additional means of moving the droplets to the recording medium.

16. The system of claim 15, wherein said heaters surround respective ones of said nozzles for applying heat to the selected ones of the menisci and to the neck portions thereof.

17. The system of claim 15, wherein said heater control circuit controls each of said heaters, so that heat is applied to the neck portions at a predetermined time after pressurization of said ink bodies.

18. The system of claim 17, wherein said heater control circuit controls each of said heaters, so that heat is applied to the neck portions at a time immediately preceding maximum outwardly extension of the selected ones of the menisci from the orifices.

19. The system of claim 18, wherein said heaters heat the ink to a temperature below that which would cause a vapor bubble to be created.

20. The system of claim 15, further comprising a driver control circuit connected to said transducers for controlling said transducers, so that said transducers controllably oscillate to alternately pressurize and depressurize the ink bodies.

21. A drop on demand print head comprising:

(a) a plurality of drop-emitter nozzles;

(b) a body of ink associated with said nozzles;

(c) a plurality of mechanically isolated pressurizing devices adapted to subject said body of ink to a pulsating pressure above ambient, to intermittently form an extended meniscus in all of said plurality of nozzles, and wherein the number of pressurizing devices is greater than one and less than the number of nozzles; and (d) drop separation apparatus selectively operable upon the meniscus of predetermined nozzles when the meniscus is extended to cause ink from the selected nozzles to separate as drops from the body of ink, while allowing ink to be retained in non-selected nozzles.

22. The print head of claim 21, wherein said drop separation apparatus comprises heaters that are adapted to heat the ink to a temperature below that which would cause a vapor bubble to be generated.

23. An image forming method, comprising the steps of (a) pressurizing an ink body by operating a plurality of mechanically isolated transducers so that an ink meniscus extends from each of a plurality of nozzle orifices, the meniscus having a predetermined surface tension, and wherein the number of transducers is greater than one and less than the number of nozzle orifices; and (b) lowering the surface tension of the meniscus while the meniscus is extending from the ink body by operating an ink droplet separator associated with a nozzle orifice selected for ejection of a droplet, whereby the droplet separator separates the meniscus from the ink body to form an ink droplet that is ejected at a speed sufficient to require no additional means of moving the droplet to a receiver.

24. The method of claim 23, wherein the step of lowering the surface tension comprises the step of lowering the surface tension by operating a droplet separator having a heater for heating a neck region of the meniscus.

25. The method of claim 24, further comprising the step of controlling the heater by operating a first control circuit connected to the heater, so that the heater controllably heats the meniscus at a predetermined time.

26. The method of claim 23, further comprising the step of controlling the mechanically isolated transducers by operating a second control circuit connected to said transducers, so that transducers controllably and uniformly pressurize the ink body.

27. An inkjet image forming method, comprising the steps of:

(a) for each of plural nozzles accommodating an ink meniscus of predetermined surface tension each connected to an ink body held in a chamber defined by a nozzle, the nozzle having a nozzle orifice in communication with the chamber;

(b) alternately pressurizing and depressurizing an ink channel communicating with each ink body by operating a plurality of mechanically isolated oscillatable transducers in fluid communication with the ink channel, so that each ink body oscillates as the ink channel is alternately pressurized and depressurized and so that the meniscus extends and retracts as the ink channel is respectively pressurized and depressurized, whereby the ink body oscillates in the chamber as the transducers oscillate, the ink body is alternately pressurized and depressurized as the ink body oscillates, and the meniscus extends from the orifice as the ink body is pressurized, and wherein the number of the transducers is greater than one and less than the number of nozzle orifices; and (c) for an orifice selected for ejection of a droplet lowering the surface tension of the meniscus while the meniscus is extending from a selected orifice by operating a droplet separator, whereby the separator lowers the surface tension of the meniscus as the meniscus extends from the selected orifice, and the meniscus separates from the selected orifice as the surface tension is lowered.

28. The method of claim 27, wherein the step of lowering the surface tension of the meniscus comprises the step of lowering the surface tension by operating a droplet separator having a heater for heating a neck region of the meniscus.

29. The method of claim 28, and wherein a droplet is ejected at a speed sufficient to require no additional means of moving the droplet to a receiver.

30. The method of claim 29 and wherein the transducers during oscillation alternately pressurize the channel to a pressure greater than ambient and less than ambient.

31. The method of claim 30 and wherein the heater heats a meniscus to a temperature greater than 100 degrees C but less than that needed to form a vapor bubble.

32. The method of claim 27, wherein the step of alternately pressurizing and depressurizing the ink channel by operating a plurality of mechanically isolated oscillatable transducers in fluid communication with the ink channel comprises the step of operating a plurality of mechanically isolated piezoelectric transducers.

33. The method of claim 27, wherein the step of alternately pressurizing and depressurizing the ink channel by operating a plurality of mechanically isolated oscillatable transducers in fluid communication with the ink channel comprises the step of operating a plurality of electromagnetic transducers.

34. A drop-on-demand inkjet image forming method for forming an image on a recording medium, comprising the steps of;

(a) operating a printhead having a plurality of nozzles integrally connected to the printhead, each nozzle defining a chamber therein for holding an ink body, each of the nozzles having a nozzle orifice in communication with respective ones of the chambers, each orifice accommodating an ink meniscus of predetermined surface tension connected to the ink body;

(b) operating a plurality of mechanically isolated oscillatable piezoelectric transducers in fluid communication with all the ink bodies for alternately and uniformly pressurizing and depressurizing the ink bodies, so that the ink bodies oscillate as the ink bodies are alternately and uniformly pressurized and depressurized and so that the menisci oscillate as the ink bodies oscillate, the number of transducers being less than the number of nozzles;

(c) operating a plurality of heaters and in heat transfer communication with respective ones of the ink menisci for lowering the surface tension of selected ones of the menisci as the ink bodies are pressurized; and (d) operating a heater control circuit connected to each of the heaters for actuating selected ones of the heaters, so that the selected ones of the heaters controllably heats the selected ones of the menisci, whereby each of the ink bodies oscillates as the transducers oscillate, whereby each of the ink bodies is alternately pressurized and depressurized as each of the ink bodies oscillate, whereby each of the menisci oscillates as each of the ink bodies oscillates, whereby the surface tension of the selected ones of the menisci is lowered as the selected ones of the menisci are heated, whereby the selected ones of the menisci each defines a neck portion thereof as the surface tension lowers, whereby each of the neck portions sever as the surface tension lowers, and whereby the selected ones of the menisci separate from the orifices corresponding thereto as the neck portions thereof sever in order to form a plurality of ink droplets, each droplet being formed at a respective orifice associated with a selected meniscus.

35. The method of claim 34, wherein the step of operating a plurality of heaters comprises the step of operating a plurality of heaters surrounding respective ones of the nozzles for applying heat to the selected ones of the menisci and to the neck portions thereof.

36. The method of claim 34, wherein the step of operating the heater control circuit comprises the step of controlling each of the heaters, so that heat is applied to the neck portions at a predetermined time after pressurization of the ink bodies.

37. The method of claim 34, wherein the step of operating the heater control circuit comprises the step of controlling each of the heaters, so that heat is applied to the neck portions at a time immediately preceding maximum outwardly extension of the selected ones of the menisci from the orifices.

38. The method of claim 34 and wherein each droplet ejected is ejected at a speed sufficient to require no additional means of moving the droplet to the recording medium.

39. A method of producing ink droplets from a plurality of drop-emitter nozzles; said method comprising:

(a) providing a body of ink associated with said plurality of nozzles;

(b) subjecting ink in said body of ink to a pulsating pressure above ambient by operating a plurality of mechanically isolatable transducers to intermittently form an extended meniscus, the number of transducers being greater than one and less than the number of nozzles; and (c) operating upon the meniscus of each of predetermined selected nozzles when the meniscus thereof is extended to cause ink from the selected nozzles to separate as drops from the body of ink, while allowing ink to be retained in non-selected nozzles.

40. The method of claim 39, wherein the ink separates from the body of ink as a droplet of sufficient speed that requires no additional means of moving the droplet to a recording medium.

* * * * *